US011821296B2

(12) United States Patent
Han et al.

(10) Patent No.: US 11,821,296 B2
(45) Date of Patent: Nov. 21, 2023

(54) MIXING AND DISCHARGING DEVICE, MIXING AND DISCHARGING SYSTEM AND FRACTURING SYSTEM

(71) Applicant: YANTAI JEREH PETROLEUM EQUIPMENT & TECHNOLOGIES CO., LTD., Shandong (CN)

(72) Inventors: Maomao Han, Shandong (CN); Liang Lv, Shandong (CN); Yipeng Wu, Shandong (CN); Shuwei Li, Shandong (CN); Chunqiang Lan, Shandong (CN)

(73) Assignee: Yantai Jereh Petroleum Equipment & Technologies Co., Ltd., Yantai (CN)

( * ) Notice: Subject to any disclaimer, the term of this patent is extended or adjusted under 35 U.S.C. 154(b) by 0 days.

(21) Appl. No.: 17/534,261

(22) Filed: Nov. 23, 2021

(65) Prior Publication Data

US 2023/0029671 A1 Feb. 2, 2023

(30) Foreign Application Priority Data

Jul. 30, 2021 (CN) ..... 202110870733.0

(51) Int. Cl.
*E21B 43/26* (2006.01)
*E21B 21/06* (2006.01)
*E21B 43/267* (2006.01)

(52) U.S. Cl.
CPC ..... *E21B 43/2607* (2020.05); *E21B 21/062* (2013.01); *E21B 43/267* (2013.01); *E21B 43/26* (2013.01)

(58) Field of Classification Search
CPC .. E21B 43/2607; E21B 21/062; E21B 43/267; E21B 43/26; B01F 2101/49
See application file for complete search history.

(56) References Cited

U.S. PATENT DOCUMENTS 3,339,897 A * 9/1967 Davis, Jr. ..... B01F 35/71 366/265
4,453,829 A * 6/1984 Althouse, III ..... B01F 25/743 366/65

(Continued)

FOREIGN PATENT DOCUMENTS

CN 2170241 Y 6/1994
CN 2653117 Y 11/2004

(Continued)

OTHER PUBLICATIONS

Liao et al.; "Progress of researches and applications for high shear mixers,"; Chemical Industry and Engineering Progress, 38(3); 2019; pp. 1160-1175.

(Continued)

*Primary Examiner* — James G Sayre
(74) *Attorney, Agent, or Firm* — Crowell & Moring LLP

(57) ABSTRACT

A mixing and discharging device, a mixing and discharging system and a fracturing system are provided. The mixing and discharging device comprises a main shell, an impeller structure and a main shaft. The main shell comprises a top cover; the impeller structure is in the main shell; the main shaft is configured to drive the impeller structure to rotate, penetrates through the top cover and extends into the main shell; a bottom end of the main shaft is in the main shell and is fixed on the impeller structure, and the bottom end of the main shaft is separated from the shell.

18 Claims, 6 Drawing Sheets

(56) References Cited

U.S. PATENT DOCUMENTS

| | | | | |
|---|---|---|---|---|
| 4,460,276 | A * | 7/1984 | Arribau | E21B 21/062 366/65 |
| 6,193,402 | B1 * | 2/2001 | Grimland | B01F 33/5026 366/14 |
| 9,022,120 | B2 | 5/2015 | Zamora et al. | |
| 9,328,599 | B2 | 5/2016 | Pich et al. | |
| 9,833,756 | B2 | 12/2017 | Stoppler | |
| 2014/0069650 | A1 * | 3/2014 | Stegemoeller | B01F 25/74 166/305.1 |
| 2016/0047184 | A1 * | 2/2016 | Luharuka | B01F 35/2136 166/250.01 |
| 2016/0216171 | A1 * | 7/2016 | Moakler | E21B 21/062 |
| 2016/0320347 | A1 * | 11/2016 | Moakler | G01H 1/003 |
| 2020/0149556 | A1 * | 5/2020 | Judge | E21B 43/2607 |

FOREIGN PATENT DOCUMENTS

| | | | |
|---|---|---|---|
| CN | 202322712 | U | 7/2012 |
| CN | 102806027 | A | 12/2012 |
| CN | 103193160 | A | 7/2013 |
| CN | 203066935 | U | 7/2013 |
| CN | 103381339 | A | 11/2013 |
| CN | 103640981 | A | 3/2014 |
| CN | 103958039 | A | 7/2014 |
| CN | 203899476 | U | 10/2014 |
| CN | 104147953 | A | 11/2014 |
| CN | 104741012 | A | 7/2015 |
| CN | 204447897 | U | 7/2015 |
| CN | 105251403 | A | 1/2016 |
| CN | 105854559 | A | 8/2016 |
| CN | 205850752 | U | 1/2017 |
| CN | 206045899 | U | 3/2017 |
| CN | 103628852 | B | 5/2017 |
| CN | 106774107 | A | 5/2017 |
| CN | 107159046 | A | 9/2017 |
| CN | 206661107 | U | 11/2017 |
| CN | 206735275 | U | 12/2017 |
| CN | 206935166 | U | 1/2018 |
| CN | 107774144 | A | 3/2018 |
| CN | 107902427 | A | 4/2018 |
| CN | 207169595 | U | 4/2018 |
| CN | 207497930 | U | 6/2018 |
| CN | 207652980 | A | 7/2018 |
| CN | 108371894 | A | 8/2018 |
| CN | 208086829 | U | 11/2018 |
| CN | 107381380 | B | 12/2018 |
| CN | 208260574 | U | 12/2018 |
| CN | 208500947 | U | 2/2019 |
| CN | 109399459 | A | 3/2019 |
| CN | 109879079 | A | 6/2019 |
| CN | 208934678 | U | 6/2019 |
| CN | 110077965 | A | 8/2019 |
| CN | 209476032 | U | 10/2019 |
| CN | 110482250 | A | 11/2019 |
| CN | 110989603 | A | 4/2020 |
| CN | 111005710 | A | 4/2020 |
| CN | 210655305 | U | 6/2020 |
| CN | 111361955 | A | 7/2020 |
| CN | 211190074 | U | 8/2020 |
| CN | 211225549 | U | 8/2020 |
| CN | 211384571 | U | 9/2020 |
| CN | 211448645 | U | 9/2020 |
| CN | 211636063 | U | 10/2020 |
| CN | 110371856 | B | 11/2020 |
| CN | 112373864 | A | 2/2021 |
| CN | 112389950 | A | 2/2021 |
| CN | 113385091 | A | 9/2021 |
| CN | 113428616 | A | 9/2021 |
| DE | 102015218686 | A1 | 3/2017 |
| JP | 2005 205407 | A | 8/2005 |

OTHER PUBLICATIONS

Tai, Guang-feng et al.; "Study on an Intelligent Control System of the Sand Conveyance Device for Factory Fracturing"; China Academic Journal Electronic Publishing House Mining & Metallurgy, vol. 24, No. 5; Oct. 2015; pp. 67-61.

* cited by examiner

MIXING AND DISCHARGING DEVICE, MIXING AND DISCHARGING SYSTEM AND FRACTURING SYSTEM

The application claims priority to the Chinese patent application No. 202110870733.0, filed on Jul. 30, 2021, the entire disclosure of which is incorporated herein by reference as part of the present application.

TECHNICAL FIELD

At least one embodiment of the present disclosure relates to a mixing and discharging device, a mixing and discharging system and a fracturing system.

BACKGROUND

A sand mixing device is a core device in a complete set of fracturing system and is mainly used for mixing fracturing base liquid, proppants (for example, gravels) and chemical additives which are supplied upstream to obtain fracturing liquid and finally supplying the mixed fracturing liquid to pumping equipment downstream. At present, the mixing and discharging system with an integration function comprises the sand mixing device; for example, a mixing and discharging system with integrated functions of sucking a liquid material, mixing a solid material with the liquid material and discharging a solid-liquid mixed material gradually starts to be used. The solid material and the liquid material are generally input into a tank for summary; an impeller structure is arranged in the tank; and a main shaft is driven to rotate so as to drive the impeller structure to rotate and mix the solid material with the liquid material.

SUMMARY

At least one embodiment of the present disclosure provides a mixing and discharging device, and the mixing and discharging device comprises a main shell, an impeller structure and a main shaft. The main shell comprises a top cover; the impeller structure is in the main shell; the main shaft is configured to drive the impeller structure to rotate, penetrates through the top cover and extends into the main shell; a bottom end of the main shaft is in the main shell and is fixed on the impeller structure, and the bottom end of the main shaft is separated from the shell.

For example, in the mixing and discharging device provided by at least an embodiment of the present disclosure, the main shell further comprises a bottom surface opposite to the top cover, and the bottom end of the main shaft is separated from the bottom surface.

For example, in the mixing and discharging device provided by at least an embodiment of the present disclosure, the impeller structure is at a preset position close to the top cover in the main shell.

For example, in the mixing and discharging device provided by at least an embodiment of the present disclosure, the impeller structure has an upper end close to the top cover in an axial direction of the main shaft a ratio of a distance between the upper end of the impeller structure and the top cover to a size of an inner space of the main shell in the axial direction is less than 1:2.

For example, in the mixing and discharging device provided by at least an embodiment of the present disclosure, the ratio of the distance between the upper end of the impeller structure and the top cover to the size of the inner space of the main shell in the axial direction is less than 1:10.

For example, in the mixing and discharging device provided by at least an embodiment of the present disclosure, the impeller structure comprises a wheel disc and blades arranged at an edge of the wheel disc; the wheel disc comprises a shaft hole; the impeller structure comprises an upper end close to the top cover and a lower end away from the top cover; the main shaft passes through the shaft hole in a direction from the upper end of the impeller structure to the lower end of the impeller structure, and the bottom end of the main shaft is fixed to the lower end of the impeller structure.

For example, the mixing and discharging device provided by at least an embodiment of the present disclosure further comprises a bearing assembly which is configured to support and fix the main shaft and is outside the main shell.

For example, in the mixing and discharging device provided by at least an embodiment of the present disclosure, the bearing assembly comprises: a first bearing component and a second bearing component; the first bearing component is configured to support and fix the main shaft and is outside the main shell; and the second bearing component is configured to support and fix the main shaft, arranged with the first bearing component in the axial direction and at a side, away from the main shell, of the first bearing component.

For example, the mixing and discharging device provided by at least an embodiment of the present disclosure further comprises a connection component, and the connection component is configured to detachably connect the bearing assembly with the main shell.

For example, in the mixing and discharging device provided by at least an embodiment of the present disclosure, the top cover is provided with a feeding opening which penetrates through the top cover; the mixing and discharging device further comprises a feeding hopper; the feeding hopper is connected with the main shell and comprises a lower opening close to the main shell and an upper opening away from the main shell; the upper opening, the lower opening of the feeding hopper and the feeding opening are communicated in sequence.

For example, in the mixing and discharging device provided by at least an embodiment of the present disclosure, the connection component comprises a connection box, and the connection box is outside the main shell, sleeved on the main shaft and connected with the feeding hopper; the first bearing component comprises a first bearing and a first bearing seat configured to fix the first bearing, the second bearing component comprises a second bearing and a second bearing configured to fix the second bearing, and the first bearing seat and the second bearing seat are fixed on an inner wall of the connection box.

For example, in the mixing and discharging device provided by at least an embodiment of the present disclosure, the connection box comprises a first cylinder and a second cylinder. The first cylinder is sleeved on the main shaft and extends in the axial direction of the main shaft; and the second cylinder is sleeved on the main shaft, extends in the axial direction of the main shaft, is connected and communicated with the first cylinder and is at a side, away from the main shell, of the first cylinder; a size of the second cylinder in a transverse direction vertical to the axial direction of the main shaft is larger than that of the first cylinder in the transverse direction vertical to the axial direction of the main shaft.

For example, in the mixing and discharging device provided by at least an embodiment of the present disclosure, the inner wall of the connection box comprises a step structure at a junction between the first cylinder and the second cylinder, the step structure comprises a step surface vertical to the axial direction, and the second bearing seat is on the step structure.

For example, in the mixing and discharging device provided by at least an embodiment of the present disclosure, the main shell comprises a side surface intersected with the bottom surface and the top cover, the side surface of the main shell comprises a liquid inlet and a liquid outlet, and the liquid inlet is at a side, close to the top cover, of the liquid outlet.

For example, in the mixing and discharging device provided by at least an embodiment of the present disclosure, the impeller structure comprises a plurality of layers of blades, and the plurality of layers are arranged in the axial direction of the main shaft.

At least one embodiment of the present disclosure further provides a mixing and discharging system, and the mixing and discharging system comprises any one of the mixing and discharging devices provided by the embodiments provided by the embodiments of the present disclosure.

For example, the mixing and discharging system provided by at least an embodiment of the present disclosure further comprises a material transportation device and a driver device, the material transportation device is configured to input a material into the main shell, and the driver device is configured to drive the main shaft to rotate so as to drive the impeller structure to rotate.

For example, in the mixing and discharging system provided by at least an embodiment of the present disclosure, in the case where the main shell comprises a liquid inlet and a liquid outlet, the mixing and discharging system further comprises a liquid inlet pipe manifold and a liquid outlet pipe manifold. The liquid inlet pipe manifold is connected with the liquid inlet; the liquid outlet pipe manifold is connected with the liquid outlet.

For example, in the mixing and discharging system provided by at least an embodiment of the present disclosure, the mixing and discharging device comprises a first mixing and discharging device and a second mixing and discharging device which are connected in parallel with each other; the liquid inlet pipe manifold comprises a first liquid inlet pipe manifold and a second liquid inlet pipe manifold, and the first liquid inlet pipe manifold is connected with the second liquid inlet pipe manifold through a first connection pipe; the liquid outlet pipe manifold comprises a first liquid outlet pipe manifold and a second liquid outlet pipe manifold, and the first liquid outlet pipe manifold is connected with the second liquid outlet pipe manifold through a second connection pipe; the first liquid inlet pipe manifold is connected with a liquid inlet of the first mixing and discharging device; the second liquid inlet pipe manifold is connected with a liquid inlet of the second mixing and discharging device; the first liquid outlet pipe manifold is connected with a liquid outlet of the first mixing and discharging device; the second liquid outlet pipe manifold is connected with a liquid outlet of the second mixing and discharging device; and valves are respectively arranged in the first connection pipe, the second connection pipe, the first liquid inlet pipe manifold, the second liquid inlet pipe manifold, the first liquid outlet pipe manifold and the second liquid outlet pipe manifold.

At least one embodiment of the present disclosure further provides a fracturing system, and the fracturing system comprises any one of the mixing and discharging systems provided by the embodiments provided by the embodiments of the present disclosure.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

Figure 1:
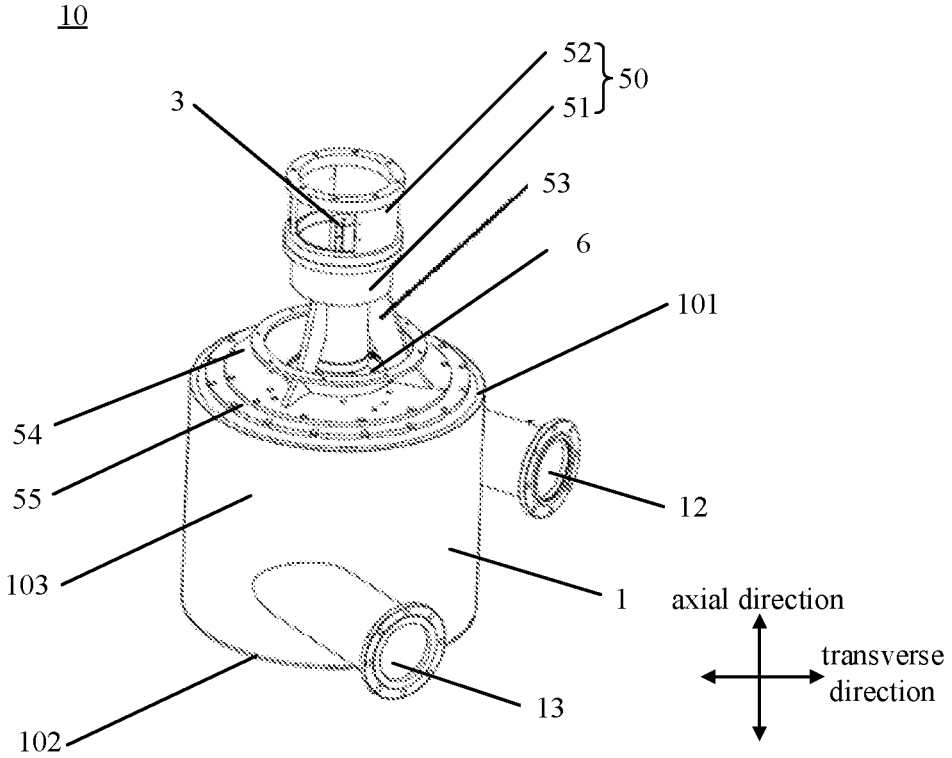
FIG. 1 is an overall schematic diagram of a mixing and discharging device provided by an embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms "comprise," "comprising," "include," "including," etc., are intended to specify that the elements or the objects stated before these terms encompass the elements or the objects and equivalents thereof listed after these terms, but do not preclude the other elements or objects. "Inside," "outside" "on," "under," and the like are only used to indicate relative position relationship, and when the position of the object which is described is changed, the relative position relationship may be changed accordingly.

The dimensions of the drawings used in the present disclosure are not drawn strictly according to actual scale, and the specific size and quantity of each structure can be determined according to actual needs. The drawings described in this disclosure are only structural schematic diagrams.

At least one embodiment of the disclosure provides a mixing and discharging device, and the mixing and discharging device comprises a main shell, an impeller structure and a main shaft. The main shell comprises a top cover; the impeller structure is in the main shell; the main shaft is configured to drive the impeller structure to rotate, penetrates through the top cover and extends into the main shell; a bottom end of the main shaft is in the main shell and is fixed on the impeller structure, and the bottom end of the main shaft is separated from the shell. The mixing and discharging device provided by at least one embodiment of the present disclosure is used for mixing solid materials with liquid materials. In the mixing and discharging device provided by the embodiment of the present disclosure, the bottom end of the main shaft is located in the shell and is fixed on the impeller structure, and the bottom end of the main shaft is separated from the shell, so that the bottom end of the main shaft is not fixed on the bottom surface of the main shell by using a bearing; disassembly and maintenance of the main shaft are facilitated, so that disassembly and maintenance of the impeller structure are facilitated; meanwhile, the assembling difficulty and the manufacturing difficulty of the main shaft, the impeller structure and the whole mixing and discharging device are greatly reduced.

Figure 2:
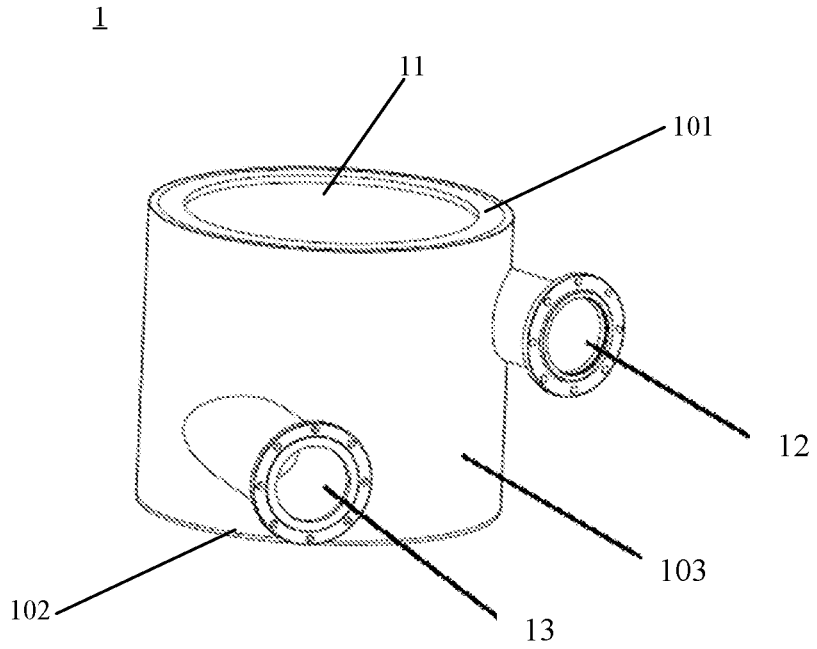
FIG. 2 is a schematic diagram of a main shell of the mixing and discharging device illustrated in FIG. 1.
Figure 3A:
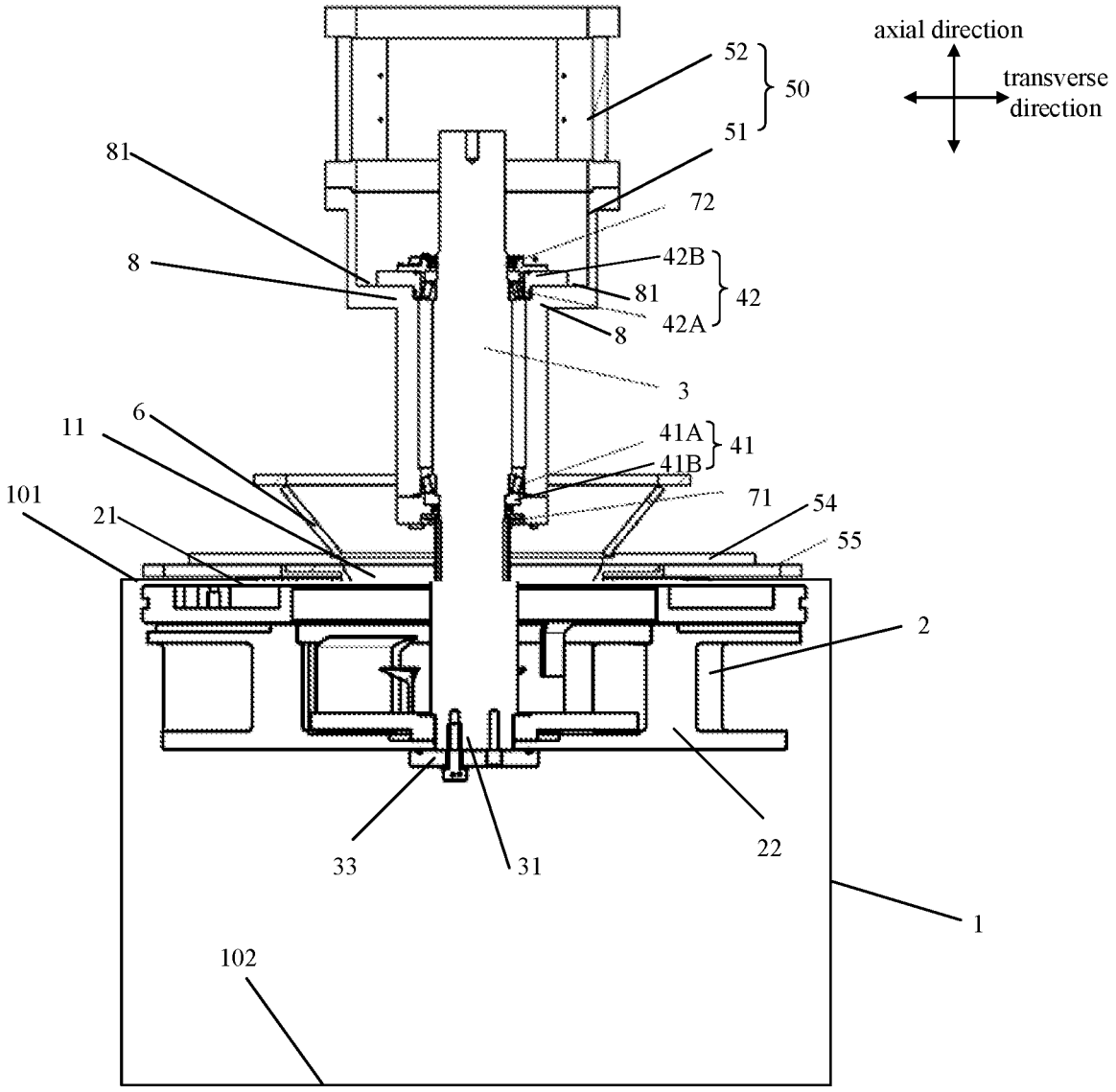
FIG. 3A is a cross-sectional schematic diagram of the mixing and discharging device illustrated in FIG. 1 in an axial direction.

Exemplarily, FIG. 1 is an overall schematic diagram of a mixing and discharging device provided by an embodiment of the present disclosure. FIG. 2 is a schematic diagram of a main shell of the mixing and discharging device illustrated in FIG. 1. FIG. 3A is a cross-sectional schematic diagram of the mixing and discharging device illustrated in FIG. 1 in an axial direction. As illustrated in FIGS. 1-3A, the mixing and discharging device 10 provided by at least one embodiment of the present disclosure comprises a main shell 1, an impeller structure 2 and a main shaft 3. The main shell 1 comprises a top cover 101; the impeller structure 2 is located in the main shell 1; the main shaft 3 is configured to drive the impeller structure 2 to rotate, and the main shaft 3 penetrates through the top cover 101 and extends into the main shell 1; the bottom end 31 of the main shaft 3 is located in the shell and is fixed on the impeller structure 2, and the bottom end 31 of the main shaft 3 is separated from (spaced apart from) the shell. Namely, a part, located in the main shell 1, of the main shaft 3 is separated from (spaced apart from) the main shell 1; and namely, the bottom end 31 of the main shaft 3 is not mounted on any wall surface of the main shell 1 and is not in contact with the main shell 1. The mixing and discharging device 10 is used for mixing a solid material with a liquid material. For example, the solid material and the liquid material are respectively input into the main shell 1; the solid material passes through the impeller structure 2 and then enters the main shell 1; the liquid material is conveyed into the main shell 1 through an opening on a side wall of the main shell 1; the solid material is scattered and uniformly thrown into the main shell 1 through rotation of the impeller structure 2, and meanwhile, the liquid material and the solid material in the main shell 1 are uniformly mixed through rotation of the impeller structure 2.

In a general mixing and discharging device, the bottom end of the main shaft is mounted on the bottom surface of the main shell; for example, the bottom end of the main shaft is positioned and mounted on the bottom surface of the main shell through a bearing; in this case, it is difficult to disassemble the impeller structure and the main shaft; for the mixing and discharging device, the impeller structure and the main shaft are easily worn, so that the impeller structure and the main shaft need to be maintained frequently; sealing components of the bearings used for bearing the main shaft are also easily damaged and are replaced frequently; therefore, for this general mixing and discharging device, it is inconvenient to disassemble the main shaft and the impeller structure, and the equipment is extremely inconveniently maintained in the later, which is not beneficial to extensive usage of this general mixing and discharging device; furthermore, for this general mixing and discharging device, the main shaft, a driver device, bearing seats and the main shell are all required to have precise matching; the manufacturing difficulty of the this general mixing and discharging device is high, and the usage reliability is influenced. However, in the mixing and discharging device 10 provided by at least one embodiment of the present disclosure, the bottom end 31 of the main shaft 3 is located in the shell and is fixed on the impeller structure 2, and meanwhile, the bottom end 31 of the main shaft 3 is separated from the shell, for example, the main shell 1 further comprises a bottom surface 102 opposite to the top cover 101; the bottom end 31 of the main shaft 3 is not fixed on the bottom surface 102 of the main shell 1 by using a bearing, so that disassembly and maintenance of the main shaft 3 are facilitated, and thus disassembly and maintenance of the impeller structure 2 are facilitated; meanwhile, the assembling difficulty and the manufacturing difficulty of the main shaft 3, the impeller structure 2 and the whole mixing and discharging device 10 are greatly reduced.

For example, as illustrated in FIGS. 1-3A, the bottom end 31 of the main shaft 3 is separated from (spaced apart from) the bottom surface 102 of the main shell 1. Namely, the main shaft 3 is not mounted on the bottom surface 102 of the shell by using a bearing.

For example, as illustrated in FIGS. 1-3A, the impeller structure 2 is located at a preset position close to the top cover 101 in the main shell 1; the top cover 101 comprises a feeding opening 11, so that the impeller structure 2 is closer to the top cover 101; the main shaft 3 and the impeller structure 2 need to be mounted in the main shell 1 through the feeding opening 11, so that the impeller structure 2 is closer to the top cover 101, and assembly and disassembly of the main shaft 3 and the impeller structure 2 are facilitated.

For example, the impeller structure comprises an upper end 21 close to the top cover 101 in an axial direction of the main shaft 3; a ratio of a distance between the upper end 21 of the impeller structure 2 and the top cover 101 to a size of an inner space of the main shell 1 in the axial direction is less than 1:2, so as to achieve a technical effect of better facilitating assembly and disassembly of the main shaft 3 and the impeller structure 2.

For example, as illustrated in FIG. 3A, the ratio of the distance between the upper end 21 of the impeller structure 2 and the top cover 101 to the size of the inner space of the main shell 1 in the axial direction is less than 1:10, so as to achieve a technical effect of better facilitating assembly and disassembly of the main shaft 3 and the impeller structure 2. For example, a small gap exists between the upper end 21 of the impeller structure 2 and the top cover 101 so as to reduce the resistance when the impeller structure 2 rotates, namely, a ratio of the size of the small gap in the axial direction to the size of the inner space of the main shell 1 in the axial direction is less than 1:10.

Figure 3B:
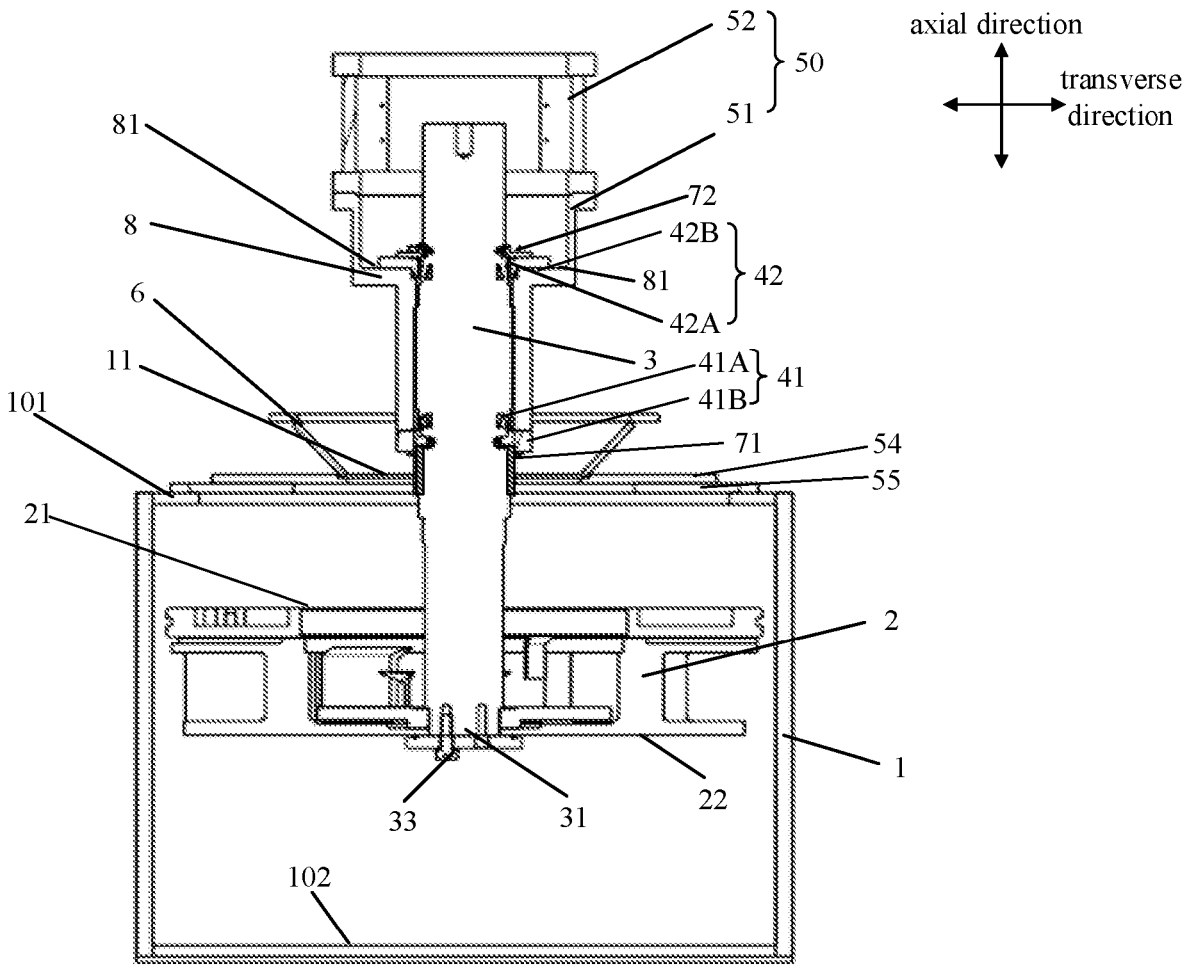
FIG. 3B is another cross-sectional schematic diagram of the mixing and discharging device illustrated in FIG. 1 in the axial direction.

FIG. 3B is another cross-sectional schematic diagram of the mixing and discharging device illustrated in FIG. 1 in the axial direction. The differences between the embodiment illustrated in FIG. 3B and the embodiment illustrated in FIG. 3A are as follows. As illustrated in FIG. 3B, the ratio of the distance between the upper end 21 of the impeller structure 2 and the top cover 101 to the size of the inner space of the main shell 1 in the axial direction is greater than that illustrated in the FIG. 3A; for example, the ratio is about 1:3, so that the effect of better stirring and mixing the solid material and the liquid material in the main shell 1 is achieved while the technical effect of facilitating assembly and disassembly of the main shaft 3 and the impeller structure 2 is achieved. The other unmentioned features of the embodiment illustrated in FIG. 3B are as same as that illustrated in FIG. 3A.

Figure 4A:
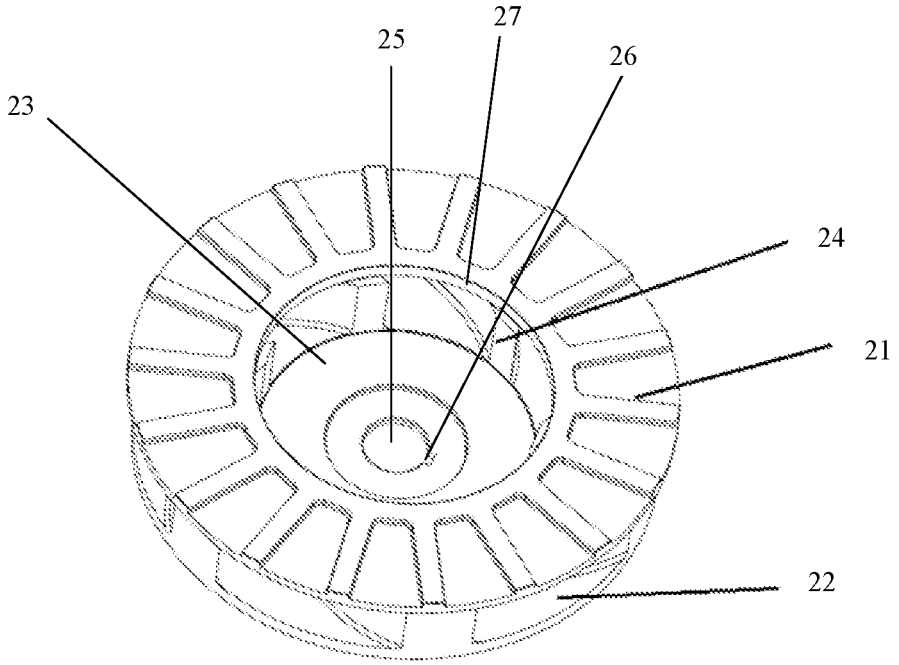
FIG. 4A is a schematic diagram of an impeller structure of the mixing and discharging device illustrated in FIG. 1.

FIG. 4A is a schematic diagram of the impeller structure of the mixing and discharging device illustrated in FIG. 1. For example, as illustrated in FIG. 4A, the impeller structure 2 comprises a wheel disc 23 and blades 24 arranged at an edge of the wheel disc 23; the wheel disc 23 comprises a shaft hole 25; the impeller structure 2 comprises an upper end 21 close to the top cover 101 and a lower end 22 away from the top cover 101; the main shaft 3 penetrates through the shaft hole 25 in a direction from the upper end 21 of the impeller structure 2 to the lower end 22 of the impeller structure 2; and the bottom end 31 of the main shaft 3 is fixed to the lower end 22 of the impeller structure 2. For example, the shaft hole 25 comprises a key groove 26; a connection key (not illustrated in figures) is arranged on the main shaft 3 and is bonded with the key groove 26 in a matching manner; for example, a shape of the connection key is complemented with a shape of the key groove 26 so as to achieve connection of the impeller structure 2 and the main shaft 3, and thus the impeller structure 2 can be driven to rotate by driving the main shaft 3 to rotate. For example, the wheel disc 23, the blades 24, the upper end 21 (for example, the upper end 21 is an upper end cover of the impeller structure 2) of the impeller structure 2 and the lower end 22 (for example, the lower end 22 is a lower end cover of the impeller structure 2) of the impeller structure 2 constitute an integrated structure, and the integrated structure is driven to rotate along with the main shaft 3 under driving of the main shaft 3 in the working process of the mixing and discharging device 10.

For example, as illustrated in FIG. 4A, the impeller structure 2 comprises an opening 27; the solid material enters the impeller structure 2 through the opening 27, is subsequently scattered by the rotating impeller structure 2 and is then thrown into the main shell 1 through the rotating impeller structure 2.

Combining FIG. 4A and FIG. 3A, an orthographic projection of the feeding opening 11 of the top cover 101 on a plane where the upper surface of the top cover 101 is located is within an orthographic projection of the opening 27 of the impeller structure 2 on the plane where the upper surface of the top cover 101 is located, so as to ensure that the solid material input through the feeding opening 11 basically totally enters the opening 27 of the impeller structure 2.

Figure 4B:
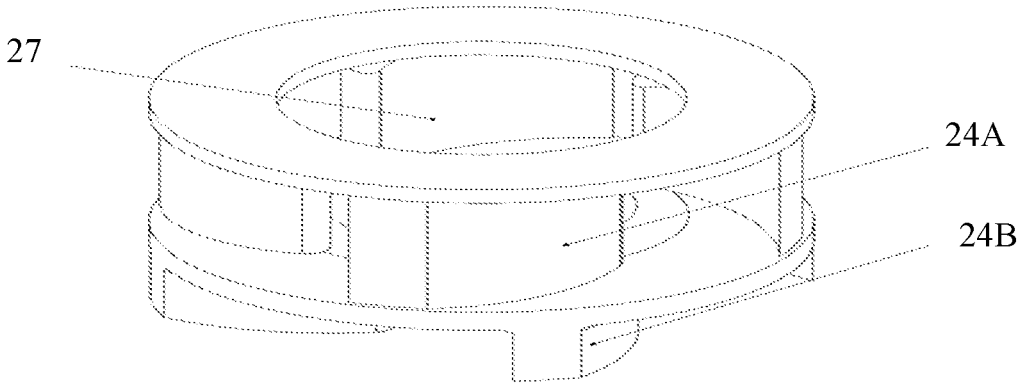
FIG. 4B is another schematic diagram of the impeller structure of the mixing and discharging device illustrated in FIG. 1.

FIG. 4B is another schematic diagram of the impeller structure of the mixing and discharging device illustrated in FIG. 1. With reference to FIG. 4B, for example, the impeller structure 2 comprises a plurality of layers of blades 24 arranged in the axial direction of the main shaft 3, that is, the plurality of layers of blades 24 are stacked and spaced apart from each other in the axial direction. For example, the impeller structure 2 comprises a first layer of blades 24A and a second layer of blades 24B which are arranged in the axial direction of the main shaft 3; and each layer of blades 24 comprise at least three blades. Of course, the impeller structure 2 may has only one layer of blades or more than two layers of blades; for example, the impeller structure 2 comprises three layers or four layers of blades arranged in the axial direction of the main shaft 3 so as to enhance the stirring effect of the impeller structure 2.

Figure 4C:
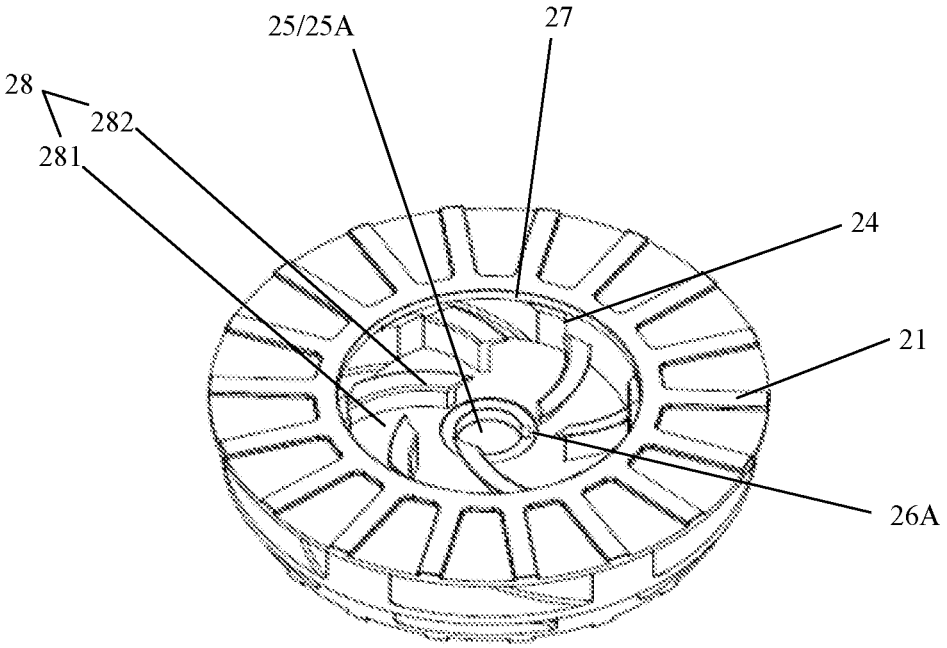
FIG. 4C is another schematic diagram of the impeller structure of the mixing and discharging device illustrated in FIG. 1.
Figure 4D:
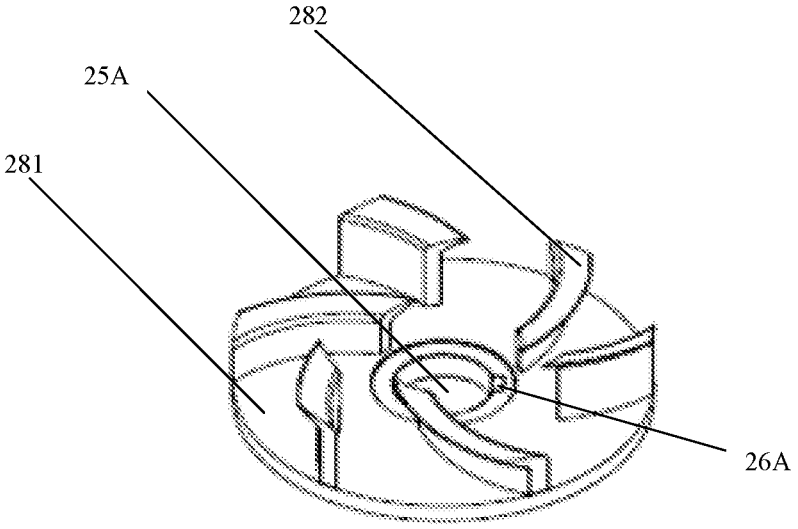
FIG. 4D is a schematic diagram of a grinding wheel of the impeller structure illustrated in FIG. 4C.

FIG. 4C is another schematic diagram of the impeller structure of the mixing and discharging device illustrated in FIG. 1. FIG. 4D is a schematic diagram of a grinding wheel of the impeller structure illustrated in FIG. 4C. As illustrated in FIGS. 4C-4D, the impeller structure 2 further comprises a grinding wheel 28. The impeller structure 2 is provided with an opening 27 located at the middle of the impeller structure 2, the grinding wheel 28 is located in the opening 27, inside the blades 24 of the impeller structure 2 and is fixed on the wheel disc 23 of the impeller structure, that is, the grinding wheel 28 is surrounded by the blades 24. For example, the grinding wheel 28 comprises a grinding wheel rotation disc 281, a plurality of grinding wheel blades 282 located at an edge of the grinding wheel rotation disc 281 and a grinding wheel shaft hole 25A penetrating through the grinding wheel rotation disc 281; the plurality of grinding wheel blades 282 surround the grinding wheel shaft hole 25A. For example, the shaft hole 25A comprises a key groove 26A, and a connection key (not shown in figures) is arranged on the main shaft 3, and the connection key is bonded with the key groove 26A in a matching manner; for example, a shape of the connection key is complemented with a shape of the key groove 26A so as to achieve connection of the grinding wheel 28 and the main shaft 3, and the whole impeller structure 2 is connected with the main shaft 3, and thus the impeller structure 2 can be driven to rotate by driving the main shaft 3 to rotate. The solid material(s) enters the grinding wheel 28 through the opening 27; the solid material (proppant) is firstly scattered by the grinding wheel 28, subsequently scattered by the external blades 24 of the rotating impeller structure 2 and then thrown into the main shell 1 by the rotating impeller structure 2, therefore, uniform mixing of the solid material (s) is better facilitated.

For example, in the impeller structure illustrated in FIG. 4C, the opening at the middle of the rotation disc 23 of the impeller structure is large and the rotation disc 23 of the impeller structure does not comprise the key groove 26 illustrated in FIG. 4A; an orthographic projection of the grinding wheel shaft hole 25A on a surface, facing the grinding wheel 28, of the rotation disc 23 and an orthographic projection of the key groove 26A on the surface, facing the grinding wheel 28, of the rotation disc 23 are within an orthographic projection of the opening at the middle of the rotation disc 23 on the surface, facing the grinding wheel 28, of the rotation disc 23; or, the orthographic projection of the grinding wheel shaft hole 25A on the surface, facing the grinding wheel 28, of the rotation disc 23 and the orthographic projection of the key groove 26A on the surface, facing the grinding wheel 28, of the rotation disc 23 are respectively overlapped with an orthographic projection of the shaft hole 25 illustrated in FIG. 4A on the surface, facing the grinding wheel 28, of the rotation disc 23 and an orthographic projection of the key groove 26 illustrated in FIG. 4A on the surface, facing the grinding wheel 28, of the rotation disc 23.

In the mixing and discharging device 10 provided by the embodiment of the present disclosure, the design of the bearings and the design of the connection component are critical to better implementation of position limitation and fixation of the main shaft 3 and the impeller structure 2. For example, as illustrated in FIG. 3A, the mixing and discharging device 10 further comprises a bearing assembly; the bearing assembly is configured to support and fix the main shaft 3, and the bearing assembly configured to support and fix the main shaft 3 is located outside the main shell 1, namely, the bearing assembly configured to support and fix the main shaft 3 does not exist in the main shell 1, so that convenience in assembly, disassembly and maintenance of the main shaft 3 is greatly improved.

For example, as illustrated in FIG. 3A, the bearing assembly comprises a first bearing component 41 and a second bearing component 42. The first bearing component 41 is configured to support and fix the main shaft 3 and is located outside the main shell 1. The second bearing component 42 is configured to support and fix the main shaft 3, is arranged with the first bearing component 41 in the axial direction and is located at a side, away from the main shell 1, of the first bearing component 41. Thus, the two bearing assembly are both located outside the shell, so that disassembly of the first bearing component 41, the second bearing component 42 and the main shaft 3 is facilitated; meanwhile, the stability degree of the main shaft is enhanced, the phenomenon that the main shaft is a cantilever is avoided, and a stable operation of the main shaft is ensured.

For example, as illustrated in FIG. 3A, the mixing and discharging device 10 further comprises a connection component, and the connection component is configured to detachably connect the bearing assembly with the main shell 1, so as to achieve position limitation of the main shaft 3 and the impeller wheel 2.

Specifically, for example, the top cover 101 is provided with a feeding opening 11 penetrating through the top cover 101; the mixing and discharging device further comprises a feeding hopper 6; the feeding hopper 6 is connected with the main shell 1 and comprises a lower opening close to the main shell 1 and an upper opening away from the main shell 1; and the upper opening of the feeding hopper 6 and the lower opening of the feeding hopper 6 are communicated with the feeding opening 11 in sequence. For example, a size of the upper opening is larger than a size of the lower opening; and the lower opening is basically aligned to the feeding opening 11 of the top cover 101. Therefore, the solid material(s) sequentially passes through the upper opening of the feeding hopper 6, the lower opening of the feeding hopper 6 and the feeding opening 11 to enter the main shell 1. For example, the solid material enters the impeller structure 2 first, is subsequently scattered by the rotating impeller structure 2 and is then thrown into the main shell 1 through the rotating impeller structure 2.

For example, as illustrated in FIG. 1 and FIG. 3A, the connection component comprises a connection box 50; the connection box 50 is located outside the main shell 1, sleeved on the main shaft 3 and connected with the feeding hopper 6, so that the connection box 20 is fixed on the main shell 1 through the feeding hopper 6; the bearings are fixed on the connection box 50 through the bearing seats, namely, the main shaft, the bearing assembly, the connection box, the feeding hopper 6 and the main shell 1 are connected in sequence, so that the main shaft 3 and the impeller structure 2 connected with the main shaft 3 are limited in preset fixing positions. The connection component and the main shaft can be accurately and reliably positioned, and mounting convenience and performance reliability of the mixing and discharging device are improved.

For example, the connection component further comprises a connection plate; the connection plate is detachably connected with the main shell 1; for example, the connection plate is connected with the main shell 1 through bolts; for example, the connection plate is a flange plate; of course, the connection mode is not limited in the embodiments of the present disclosure. Auxiliary connection parts 53 are connected with the main shell 1 through the connection plate. For example, the connection plate comprises a first connection plate 54 and a second connection plate 55; for example, the first connection plate 54 and the second connection plate 55 are covered on the top cover 101 of the main shell 1 and are stacked in the axial direction; meanwhile, an orthographic projection of the first connection plate 54 on a plane vertical to the axial direction is within an orthographic projection of the second connection plate 55 on the plane vertical to the axial direction, so as to enhance the connection strength. For example, the connection component comprises a through hole penetrating through the first connection plate 54 and the second connection plate 55; and the through hole is communicated with the lower opening of the feeding hopper 6 and the feeding opening 11 of the top cover 101 of the main shell 1. For example, the feeding hopper 6 is connected with the connection plate, namely, the feeding hopper 6 is connected with the main shell 1 through the connection plate, and namely, the feeding hopper 6 is also one part of the connection component in this case. For example, the connection mode between the feeding hopper 6 and the connection plate is detachable connection or fixed connection.

For example, the feeding hopper 6 is connected with at least one of the first connection plate 54 and the second connection plate 55. For example, as illustrated in FIG. 3A, the feeding hopper 6 is connected with the first connection plate 54, and for example, the feeding hopper 6 is welded with the first connection plate 54. In other embodiments, the feeding hopper 6 is connected with both the first connection plate 54 and the second connection plate 55, and for example, the feeding hopper 6 is welded with the first connection plate 54 and/or the second connection plate 55. Of course, the connection mode between the feeding hopper 6 and the connection plates is not limited to welding; the connection mode is acceptable as long as the feeding hopper 6 is connected to the connection plates so as to fix the feeding hopper 6, and welding is taken as an example here.

For example, specifically, the connection component further comprises an auxiliary connection part 53; the connection box 50 is fixed on the feeding hopper 6 and the connection plate through the auxiliary connection part 53; for example, the auxiliary connection part 53 is directly connected with the feeding hopper 6 and the first connection plate 54, so as to achieve the fixation of the connection box 50. For example, the connection component comprises a plurality of the auxiliary connection parts 53; each of the plurality of auxiliary connection parts 53 is in fixed connection with the connection box 50, the feeding hopper 6 and the first connection plate 54; for example, a mode of the fixed connection is welding. Of course, the connection mode between the plurality of auxiliary connection parts 53, the connection box 50 and the feeding hopper 6 is not limited to welding; the connection mode is acceptable as long as the plurality of auxiliary connection parts 53 are in fixed connection with the connection box 50 and the feeding hopper 6, and welding is taken as an example here.

For example, as illustrated in FIG. 3A, the first bearing component 41 comprises a first bearing 41A and a first bearing seat 41B configured to fix the first bearing 41A; the first bearing component 42 comprises a second bearing 42A and a second bearing seat 42B configured to fix the second bearing 42A; the first bearing seat 41B and the second bearing seat 42B are fixed on an inner wall of the connection box 50. Thus, the bearing assembly is fixed and limited by the connection plate, the feeding hopper 6 and the connection box 50 of the connection component; and the main shaft 3 and the impeller structure 2 connected with the main shaft 3 are fixed and limited by the bearing assembly.

For example, as illustrated in FIG. 1 and FIG. 3A, the connection box 50 comprises a first cylinder 51 and a second cylinder 52. The first cylinder 51 is sleeved on the main shaft 3 and extends in the axial direction of the main shaft 3; the second cylinder 52 is sleeved on the main shaft 3, extends in the axial direction of the main shaft 3, is connected and communicated with the first cylinder 51 and is located at a side, away from the main shell 1, of the first cylinder 51; and a size of the second cylinder 52 in a transverse direction vertical to the axial direction of the main shaft 3 is larger than that of the first cylinder 51 in the transverse direction vertical to the axial direction of the main shaft 3. The first cylinder 51 and the second cylinder 52 can protect the main shaft 3 and provide a mounting platform for the first bearing seat and the second bearing seat. Meanwhile, the connection box 50 also provides a mounting platform for a driver device configured to drive the main shaft 3 to rotate; for example, an end, away from the main shell 1, of the connection box 50 is used as the mounting platform of the driver device; and for example, the end, away from the main shell 1, of the second cylinder 52 is used as the mounting platform of the driver device. For example, the driver device is an electric motor; and an electric motor mounting seat is arranged at the end, away from the main shell 1, of the second cylinder 52. The electric motor drives the main shaft 3 to rotate so as to drive the impeller structure 2 to rotate.

For example, as illustrated in FIG. 3A, a step structure 8 is arranged at a junction between the first cylinder 51 and the second cylinder 52 on the inner wall of the connection box 50, the step structure 8 comprises a step surface 81 vertical to the axial direction, and the second bearing seat 42B is mounted on the step structure 8; for example, at least a part of the second bearing seat 42B is mounted on the step surface 81.

For example, the mixing and discharging device 10 further comprises lubrication devices (not shown in figures); the lubrication devices are located at positions of each bearing seat and each bearing, and are configured to lubricate and cool the corresponding bearings so as to prolong the service life of the bearings. The lubrication devices may be filled with lubrication oil or lubrication grease. In the case that the lubrication grease is used for lubricating, the lubrication grease is regularly filled, and the operation of using the lubrication grease is simple; accessory devices such as an external circulating heat dissipation device and the like are not needed; and the fault risks such as oil leakage and the like do not exist. In the case that the lubrication oil is used for lubricating, an accessory circulating heat dissipation device need to be additionally arranged; however, the heat dissipation capability of using the lubrication oil is higher, and the effect is better when the lubrication oil is used in high-temperature environment. The lubrication device can be designed with reference to the conventional techniques in the art.

For example, as illustrated in FIG. 3A, the mixing and discharging device 10 further comprises a first sealing component 71 and a second sealing component 72 which are respectively located at the positions of the first bearing seat 41B and the second bearing seat 42B so as to seal the lubrication oil or the lubrication grease and achieve the effects of sealing, preventing dust and preventing water.

For example, as illustrated in FIGS. 1-3A, the main shell 1 comprises a side surface 103 intersected with the bottom surface 102 and the top cover 101; the side surface 103 of the main shell 1 has a liquid inlet 12 and a liquid outlet 13, and the liquid inlet 12 is located at a side, close to the top cover 101, of the liquid outlet 13. The liquid material enters the main shell 1 through the liquid inlet 12; a mixed material obtained after mixing the solid material with the liquid material is discharged out of the main shell 1 through the liquid outlet 13. For example, the mixed material is discharged into a fracturing device and is used for fracturing operation.

At least one embodiment of the present disclosure further provides a mixing and discharging system. The mixing and discharging system comprises any one of the mixing and discharging devices provided by the embodiments of the present disclosure.

Figure 5:
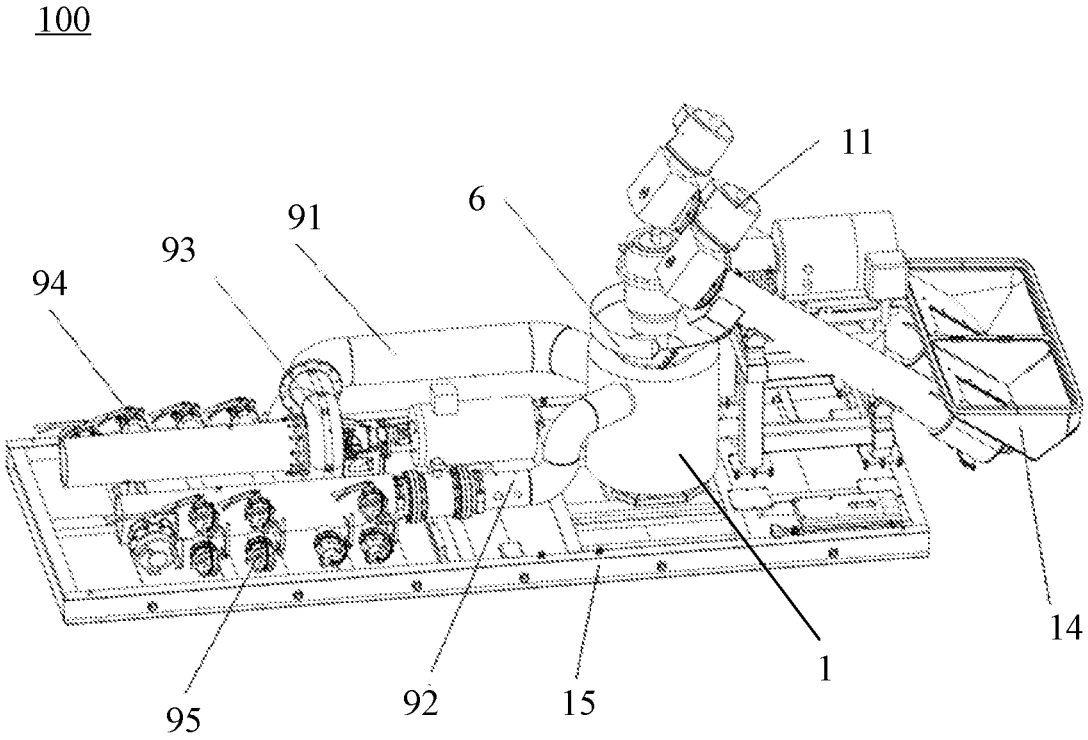
FIG. 5 is a schematic diagram of a mixing and discharging system provided by an embodiment of the present disclosure.

FIG. 5 is a schematic diagram of a mixing and discharging system 100 provided by an embodiment of the present disclosure. With reference to FIG. 5, for example, the mixing and discharging system 100 further comprises a material transportation device 14 and a driver device 11. The material transportation device 14 is configured to input materials, for example, a solid material into the main shell 1. For example, the solid material enters the impeller structure 2 through the opening 27, is subsequently scattered by the rotating impeller structure 2 and is then thrown into the main shell 1 through the rotating impeller structure 2. For example, the solid material comprises gravels, etc. The type of the solid material is not limited in the embodiments of the present disclosure and may be selected according to the actual needs. The driver device 11 is configured to drive the main shaft 3 to rotate so as to drive the impeller structure 2 to rotate.

For example, with reference to FIG. 5, the mixing and discharging system 100 further comprises a liquid inlet pipe manifold 91 and a liquid outlet pipe manifold 92. The liquid inlet pipe manifold 91 is connected with the liquid inlet 12 of the mixing and discharging device 10; and the liquid outlet pipe manifold 92 is connected with the liquid outlet 13 of the mixing and discharging device 10. A liquid material sequentially passes through a liquid inlet external suction opening 94, the liquid inlet pipe manifold 91 and the liquid inlet 12 to enter the main shell 1, and a mixed material obtained by mixing the liquid material with the solid material in the main shell 1 sequentially passes through the liquid outlet pipe manifold 92, the liquid outlet 13 and an external discharging liquid outlet 95 to be discharged out of the main shell 1.

For example, the mixing and discharging system 100 further comprises a liquid supply pump 93; and the liquid supply pump 93 is configured to drive the liquid inlet pipe manifold 91 to suck the liquid material through the liquid inlet external suction opening 94.

For example, in other embodiments, the mixing and discharging device comprises a first mixing and discharging device and a second mixing and discharging device which are connected in parallel with each other; the liquid outlet pipe manifold 91 comprises a first liquid inlet pipe manifold and a second liquid inlet pipe manifold, and the first liquid inlet pipe manifold is connected with the second liquid inlet pipe manifold through a first connection pipe; the liquid outlet pipe manifold 92 comprises a first liquid outlet pipe manifold and a second liquid outlet pipe manifold, and the first liquid outlet pipe manifold is connected with the second liquid outlet pipe manifold through a second connection pipe; the first liquid inlet pipe manifold is connected with a liquid inlet of the first mixing and discharging device; the second liquid inlet pipe manifold is connected with the liquid inlet of the second mixing and discharging device; the first liquid outlet pipe manifold is connected with the liquid outlet of the first mixing and discharging device; the second liquid outlet pipe manifold is connected with the liquid outlet of the second mixing and discharging device; and valves are respectively provided in the first connection pipe, the second connection pipe, the first liquid inlet pipe manifold, the second liquid inlet pipe manifold, the first liquid outlet pipe manifold and the second liquid outlet pipe manifold. Thus, the mixing and discharging device is composed of two pipe manifold groups; the two pipe manifold groups can work independently and are respectively connected with the first mixing and discharging device and the second mixing and discharging device which are connected in parallel with each other; the valves in the first connection pipe, the second connection pipe, the first liquid inlet pipe manifold, the second liquid inlet pipe manifold, the first liquid outlet pipe manifold and the second liquid outlet pipe manifold can be selectively switched on to switch the working pipe manifold groups; namely, the working pipe manifolds that are to work is selected from a group consisting of the first liquid inlet pipe manifold, the second liquid inlet pipe manifold, the first liquid outlet pipe manifold and the second liquid outlet pipe manifold.

At least one embodiment of the present disclosure further provides a fracturing system. The fracturing system comprises any one of the mixing and discharging systems provided by the embodiments of the present disclosure and a fracturing device. The fracturing device is connected with the mixing and discharging system; and the mixed material discharged out of the main shell 1 of the mixing and discharging device 10 provided by the embodiment of the present disclosure is discharged into the fracturing device and is used for to fracturing operation. Other structures of the fracturing system provided by the embodiment of the present disclosure can be designed with reference to the conventional techniques in the art.

What are described above is related to the illustrative embodiments of the disclosure only and not limitative to the scope of the disclosure; the scopes of the disclosure are defined by the accompanying claims.

The invention claimed is:

1. A mixing and discharging device, comprising:

a main shell comprising a top cover;

an impeller structure in the main shell;

a main shaft which is configured to drive the impeller structure to rotate, penetrates through the top cover and extends into the main shell, wherein a bottom end of the main shaft is in the main shell and is fixed on the impeller structure, and the bottom end of the main shaft is separated from the main shell; and a bearing assembly which is configured to support and fix the main shaft and is outside the main shell, comprising:

a first bearing component located outside the main shell and configured to support and fix the main shaft; and a second bearing component configured to support and fix the main shaft and arranged further away from the main shell than first bearing component in an axial direction of the main shaft.

2. The mixing and discharging device according to claim 1, wherein the main shell further comprises a bottom surface opposite to the top cover, and the bottom end of the main shaft is separated from the bottom surface.

3. The mixing and discharging device according to claim 1, wherein the impeller structure is at a preset position closer to the top cover in the main shell than a bottom of the main shell.

4. The mixing and discharging device according to claim 1, wherein a ratio of a distance between an upper end of the impeller structure and the top cover to a size of an inner space of the main shell in the axial direction is less than 1:2.

5. The mixing and discharging device according to claim 4, wherein the ratio of the distance between the upper end of the impeller structure and the top cover to the size of the inner space of the main shell in the axial direction is less than 1:10.

6. The mixing and discharging device according to claim 1, wherein the impeller structure comprises a wheel disc and blades arranged at an edge of the wheel disc, and the wheel disc comprises a shaft hole; the impeller structure comprises an upper end closer to the top cover than a bottom of the main shell and comprises a lower end away from the top cover; and the main shaft passes through the shaft hole in a direction from the upper end of the impeller structure to the lower end of the impeller structure, and the bottom end of the main shaft is fixed to the lower end of the impeller structure.

7. The mixing and discharging device according to claim 1, further comprising:

a connection component configured to detachably connect the bearing assembly with the main shell.

8. The mixing and discharging device according to claim 7, wherein the top cover is provided with a feeding opening which penetrates through the top cover; the mixing and discharging device further comprises:

a feeding hopper which is connected with the main shell and comprises a lower opening facing the main shell and an upper opening away from the main shell, wherein the upper opening, the lower opening of the feeding hopper and the feeding opening are communicated in sequence.

9. The mixing and discharging device according to claim 8, wherein the connection component comprises:

a connection box which is outside the main shell, sleeved on the main shaft and connected with the feeding hopper, wherein the first bearing component comprises a first bearing and a first bearing seat configured to fix the first bearing, the second bearing component comprises a second bearing and a second bearing seat configured to fix the second bearing, and the first bearing seat and the second bearing seat are fixed on an inner wall of the connection box.

10. The mixing and discharging device according to claim 9, wherein the connection box comprises:

a first cylinder which is sleeved on the main shaft and extends in the axial direction of the main shaft; and a second cylinder which is sleeved on the main shaft, extends in the axial direction of the main shaft, connected and communicated with the first cylinder and is at a side, away from the main shell, of the first cylinder, wherein a size of the second cylinder in a transverse direction vertical to the axial direction of the main shaft is larger than that of the first cylinder in the transverse direction vertical to the axial direction of the main shaft.

11. The mixing and discharging device according to claim 10, wherein the inner wall of the connection box comprises a step structure at a junction between the first cylinder and the second cylinder, the step structure comprises a step surface vertical to the axial direction, and the second bearing seat is on the step structure.

12. The mixing and discharging device according to claim 1, wherein the main shell comprises a side surface intersected with a bottom surface and the top cover of the main shell, the side surface of the main shell comprises a liquid inlet and a liquid outlet, and the liquid inlet is closer to the top cover than the liquid outlet in the axial direction of the main shaft.

13. The mixing and discharging device according to claim 1, wherein the impeller structure comprises at least two layers of mixing blades, and the at least two layers are arranged in the axial direction of the main shaft.

14. A mixing and discharging system, comprising the mixing and discharging device according to claim 1.

15. The mixing and discharging system according to claim 14, further comprising:

a material transportation device configured to input a material into the main shell; and a driver device configured to drive the main shaft to rotate so as to drive the impeller structure to rotate.

16. The mixing and discharging system according to claim 15, wherein the main shell comprises a liquid inlet and a liquid outlet, the mixing and discharging system further comprises:

a liquid inlet pipe manifold connected with the liquid inlet; and a liquid outlet pipe manifold connected with the liquid outlet.

17. The mixing and discharging system according to claim 16, wherein the mixing and discharging device comprises a first mixing and discharging device and a second mixing and discharging device which are connected in parallel with each other;

the liquid inlet pipe manifold comprises a first liquid inlet pipe manifold and a second liquid inlet pipe manifold, and the first liquid inlet pipe manifold is connected with the second liquid inlet pipe manifold through a first connection pipe;

the liquid outlet pipe manifold comprises a first liquid outlet pipe manifold and a second liquid outlet pipe manifold, and the first liquid outlet pipe manifold is connected with the second liquid outlet pipe manifold through a second connection pipe;

the first liquid inlet pipe manifold is connected with the liquid inlet of the first mixing and discharging device; the second liquid inlet pipe manifold is connected with the liquid inlet of the second mixing and discharging device; the first liquid outlet pipe manifold is connected with a liquid outlet of the first mixing and discharging device; the second liquid outlet pipe manifold is connected with a liquid outlet of the second mixing and discharging device; and valves are respectively arranged in the first connection pipe, the second connection pipe, the first liquid inlet pipe manifold, the second liquid inlet pipe manifold, the first liquid outlet pipe manifold and the second liquid outlet pipe manifold.

18. A fracturing system, comprising the mixing and discharging system according to claim 14.

* * * * *